United States Patent [19]

Noyes

[11] Patent Number: 4,819,337

[45] Date of Patent: Apr. 11, 1989

[54] CHALK LINE MARKING DEVICE

[76] Inventor: Tim I. Noyes, 4375 S. Weber River Dr., Ogden, Utah 84401

[21] Appl. No.: 129,131

[22] Filed: Dec. 7, 1987

[51] Int. Cl.[4] ..... B44D 3/38

[52] U.S. Cl. ..... 33/414; 33/756

[58] Field of Search ..... 33/413, 414, 137, 138

[56] References Cited

U.S. PATENT DOCUMENTS

| | | | |
|---|---|---|---|
| 265,815 | 10/1882 | Jenkins | 33/414 |
| 338,527 | 3/1886 | Hyde | 33/137 R |
| 773,016 | 10/1904 | Keuffel | 33/137 R |
| 4,152,836 | 5/1979 | Rodrique | 33/414 |
| 4,660,291 | 4/1987 | Dehn | 33/414 |

FOREIGN PATENT DOCUMENTS

| | | | |
|---|---|---|---|
| 699186 | 11/1953 | United Kingdom | 33/137 R |
| 1026051 | 4/1966 | United Kingdom | 33/414 |

*Primary Examiner*—Harry N. Haroian

*Attorney, Agent, or Firm*—A. Ray Osburn

[57] ABSTRACT

A carpenter' chalk marking device for producing marks at regular intervals along a straight line upon a working surface, characterized by chalk marking units mounted along a chalk line and configured to hold the line from contact with the marking surface to prevent extraneous marks. The device also includes a chalk containing canister with a storage spool for the chalk line.

19 Claims, 2 Drawing Sheets

CHALK LINE MARKING DEVICE

BACKGROUND OF THE INVENTION

1. Field

The field of the invention is carpenters' aid devices, and more particularly such devices for preparatory marking for installation of structural members.

2. State of the Art

In wood frame building construction, wall studs, joists, rafters and other components must often be installed at regularly spaced intervals along a straight line. The marking of a straight line between widely spaced points is typically done by using a chalk dust impregnated cord, stretched along a base member or the like providing a working surface between the points. The cord is snapped against the working surface, leaving a temporary straight line of chalk dust. Intervals along this line are then marked with pencil and carpenter's ruler, flexible tape or the like. However, in some instances, the chalk line cord has been modified to produce the spacing marks directly. U.S. Pat. No. 4,152,836 discloses a chalk line marker cord having a metal wire core covered by a flexible sleeve. The sleeve material is smooth and otherwise adapted to be resistant to retention of chalk dust. At intervals along the cord, the chalk resistant sleeve is discontinued for a short distance to be replaced by short segments of material adapted to retain the chalk. Use of this cord is intended to produce a line of correctly spaced marks along the working surface. The desired intervals are indicated by reference to the ends of the marks deposited upon the working surface. However, these marks tend to be less than precisely defined. The points of transition from chalk to bare surface tend to vary considerably. Extraneous marks also occur from chalk adhering in unwanted sites even along the smooth sleeve. Another troublesome factor is non-uniform chalking in the chalk retaining sections.

A British Patent No. 1,026,051 discloses an interval marking chalk line having chalk retention resistant sleeves, of gloss paint, e.g., at intervals. The marked line thus has spaced interruptions, rather than spaced marks as with the above discussed device. However, the same basic shortcomings exist. Any non-uniformity in the chalking of the sections leads to confusing markings by spurious interruptions of the line in the case of the British Patent, or by equally spurious extraneous marks with the U.S. patent.

Some of the above shortcomings tend to be countered by another device, disclosed in U.S. Pat. No. 4,679,325, albeit with increased complexity and cost. A flat tape, generally resistant to chalk, is used, which has perforations at the required intervals. A chalk impregnatable felt strip is provided on the side of the tape away from the working surface. The perforations allow the chalk to be deposited upon the working surfaces through these regularly spaced perforations. The tape may be less stretchable than the small wire cord with the other devices discussed herein. This contributes to accuracy in the location of the interval marks. Since the chalk carrying cloth is held away from actual contact with the working surface, the deposit of the chalk dust therethrough may be unreliable. The tape, as in the case of the wire sheath, does not completely reject deposits of chalk. With all these prior art devices, confusing unplanned marks may occur. All may produce imprecisely defined marks. Clearly, there is a need for a chalk interval marking device which avoids extraneous marks and reliably produces well defined interval marks. No prior art device provides for the contact of the working surface by only the portion of the line adapted to provide the marks to prevent the occurrence of extraneous marks.

BRIEF SUMMARY OF THE INVENTION

With the foregoing in mind, the present invention eliminates or substantially alleviates the disadvantages in the prior art, by providing a chalk marking line assembly adapted to resist retention of chalk dust except upon the outermost edges of marking units attached at spaced intervals along the line. Each marking unit extends rigidly out perpendicularly to the line when it is tightened for use, holding it from contact with the working surface. This prevents transfer of any inadvertent clinging deposits of chalk dust to the working surface.

The chalk marking units each preferably comprise a pair of rigid washers of chalk resistant material, mounted at intervals along the line. Between each pair of rigid washers is sandwiched a thin washer of material such as felt, selected for its chalk holding properties. Advantageously, the rigid washers may each be mounted as flanges upon a thin metallic sleeve crimped onto the line in the desired location. The felt marking washers are impregnated with chalk in conventional fashion, preferably within a chalk dust containing canister. The canister has an internal chalk line storage spool with an externally operated crank. Advantageously, each flange may be provided with a tapered cowling, to prevent the chalk particles from being drawn from the canister along with the line. Or, each flange may incorporate a tapered transition for the same purpose.

It is therefore the principal object of the invention to provide an improved device for producing a series of chalk marks at preselected intervals along a line, while substantially preventing unwanted confusing additional chalk marks.

BRIEF DESCRIPTION OF THE DRAWINGS

In the drawings, which represent the best modes presently contemplated for carrying out the invention.

DETAILED DESCRIPTION OF ILLUSTRATED EMBODIMENTS

Figure 1:
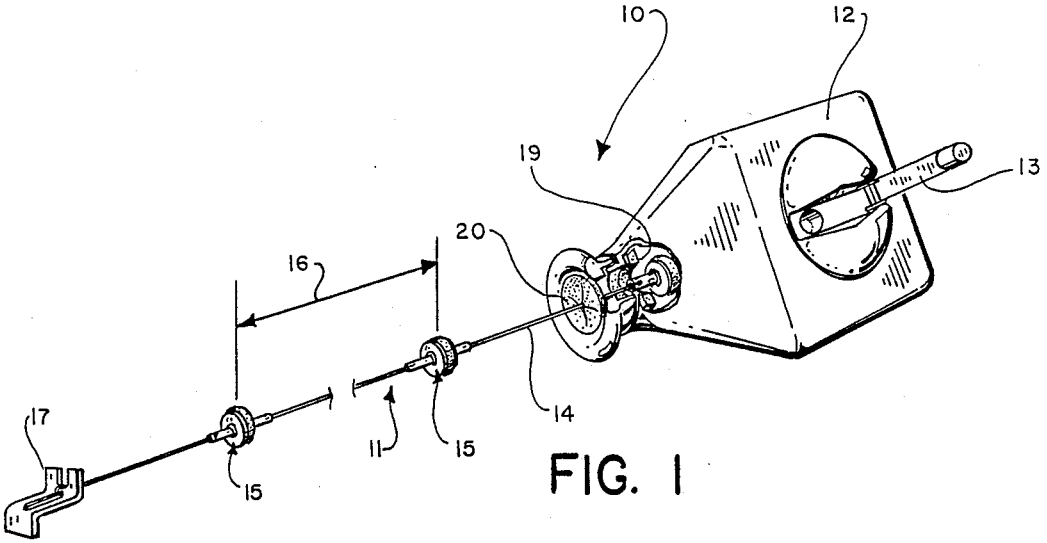
FIG. 1 is a perspective drawing of a chalk line marking device in accordance with the invention, the cord assembly thereof being shown fragmentally, and the canister thereof being partially cut away, drawn to substantially full scale, FIG. 2 a side elevation view of one of the chalk marking units of the invention, taken along line 2—2 of FIG. 1, drawn an enlarged scale, FIG. 3 a vertical sectional view of the chalk marking unit of FIG. 2, drawn to the same scale, FIG. 4 a vertical sectional view of a fragment of the chalk marking unit of FIG. 3, drawn to an enlarged scale, FIG. 5 an end view of one of the chalk marking units of FIG. 1, shown impacting a working surface, taken along line 5—5 of FIG. 1, drawn to the scale of FIGS. 2 and 3, and FIG. 6 a side elevation view of another embodiment of a chalk marking unit in accordance with the invention, having tapering cowls extending from the outer circumferences of the chalk washer retaining disc to the cord, drawn to the scale of FIG. 2.
Figure 2:
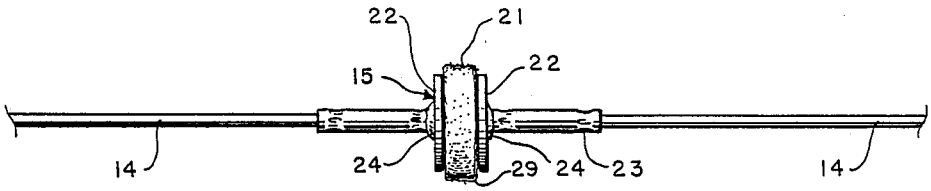
Figure 4:
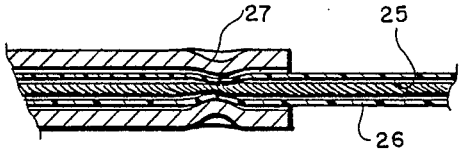
Figure 3:
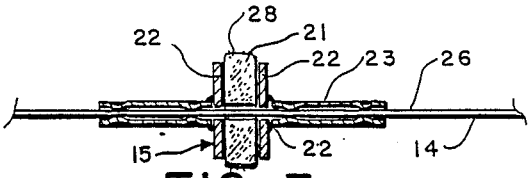

In the drawings, in which like numbers indicate like elements throughout, FIG. 1 shows an improved chalk line interval marking device 10 according to the present invention. The marking line assembly 11, shown extended for use, is retracted for storage into a canister 12 between uses by a spool, now shown, inside the canister and operated by an exterior retractable crank arm 13.

Figure 5:
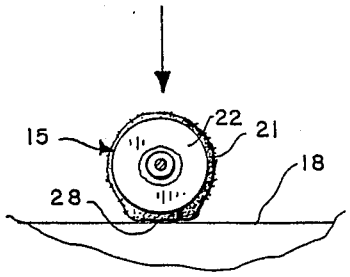

Line assembly 11 includes a flexible cord 14 and chalk marking units 15 affixed at regular intervals 16 along the cord. An end hook 17 facilitates the placement of line 11 along the surface of a work piece. The marking units 15 are adapted to trap chalk dust particles, whereas cord 14 is selected to remain as far as possible chalk free. When line assembly 11 is snapped toward and against a working surface 18, chalk marks are made only at the points of contact of the outside edges of the units 15. (FIG. 5) Marking units 15 are charged with chalk dust inside canister 12. A felt wiper collar 19 and a split wiper disc 20 of flexible resilient material may be provided to divest units 15 of excess dust as cord 14 is pulled out for use.

Each point-marking unit 15 comprises a thin washer 21 of felt or other chalk dust retaining material, held between a pair of rigid flanges 22 mounted upon a sleeve 23. (FIGS. 2-5) Preferably, flanges 22 and sleeve 23 are of metal, and secured together as by brazes 24. Line 11 preferably comprises a core wire 25 sheathed by smooth flexible plastic 26. Crimps 27 secure sleeve 23 to sheath 26.

Figure 6:
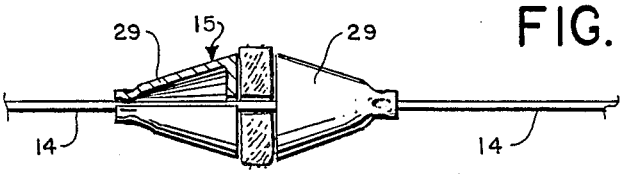
Figure 7:
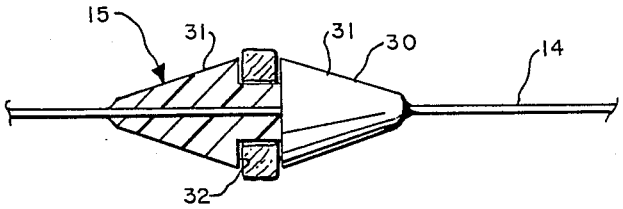
FIG. 7 a side elevation view of still another embodiment of the chalk marking unit in accordance with the invention, drawn to the scale of FIG. 2, and FIG. 8 a perspective view of the chalk line reversible end hook, drawn to substantially full scale.

Although only the chalk washers 21 are intended to trap chalk dust within canister 12, inadvertent dust deposits may occasionally adhere to other parts of cord assembly 11. For example, the surfaces of the cord 14 may be come soiled in spots with grease or the like, causing the chalk to adhere unwantedly. Or some dust may occasionally be trapped at the junctions between the sleeves 23 and the sheath 26, or in the crimps 27. The present chalk line 10 substantially prevents such deposits from being transferred to the working surface 18 to create confusing extraneous marks. All of line 11 except the edges 28 of marking units 15 is positioned well away from the working surface 18 by the rigid flanges 22. Extraneous dust deposits are unlikely to result in marks well enough defined as to be confusing without actual contact of cord 14 with working surface 18. The edges 28 of the felt washers 21 flatten against the working surface 18 to produce a distinctive rectangular mark. (FIG. 5) To alleviate the tendency of marking units 15 to dredge chalk wastefully from canister 12, cowls 29 are preferably provided. (FIG. 6) The cowls 29 enhance the effectiveness of wiper collar 19 and wiper disc 20. In another embodiment, marking unit 15 comprises a plastic body 30 molded directly upon cord 14. (FIG. 8) Body 30 has tapered ends 31 and a central circumferential groove 32 filled with chalk retaining material.

Figure 8:
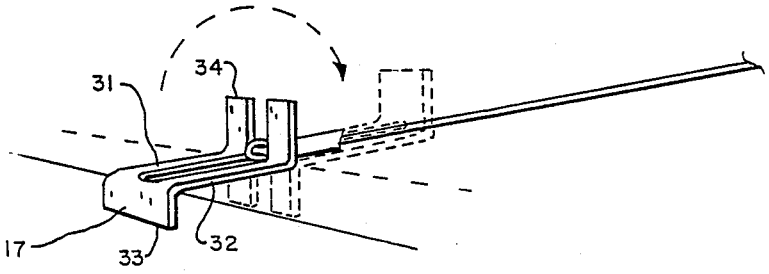

Line end hook 17, preferably comprises a rigid strip body 31 with a straight center section 32 and perpendicular, oppositely directed end tabs 33 and 34. Hook 17 is normally used as shown in FIG. 8, but may be reversed by rotation about pivot pin 35. See dashed lines, FIG. 8. In this manner, the chalk marking units may be shifted by the length of center section 32.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A chalk line marking device for producing marks at preselected intervals along a working surface, said device comprising:

a flexible cord generally resistant to the retention of chalk dust;

a multiplicity of rigid chalk dust retaining units affixed at intervals along the cord, each unit extending perpendicularly from the cord and including chalk dust retaining material, of which only portions substantially distant from the cord are exposed, so that the flexible cord tends to be prevented from contacting the working surface during use of the device; wherein each chalk dust retaining unit comprises a pair of rigid, chalk resistant washers radially outstanding from the flexible cord; and a washer of chalk retaining material sandwiched between the rigid washers and extending at least to all points of the peripheries thereof, so as to contact the working surface when the cord is stretched thereon for use, and to hold the cord away from said working surface.

2. The device of claim 1, wherein:

each of the rigid washers is secured as a flange to a sleeve affixed about the cord.

3. The device of claim 2, wherein the cord comprises a metallic wire core covered by a sheath of flexible plastic.

4. The device of claim 1, further comprising:

a chalk dust carrying canister including provisions for the storage of the cord therein, its extension therefrom for use, the impregnation of the chalk retaining washers with chalk dust, and the retraction thereinto for storage subsequent to use.

5. The device of claim 3, further comprising:

a chalk dust carrying canister including provisions for the storage of the cord therein, its extension therefrom for use, the impregnation of the chalk retaining washers with chalk dust, and the retraction thereinto for storage subsequent to use.

6. The device of claim 1, wherein each chalk dust retaining unit further comprises:

a tapered cowl spanning between the circumference of each rigid washer to the cord.

7. The device of claim 2, wherein each chalk dust retaining unit further comprises:

a tapered cowl spanning between the circumference of each rigid washer to the cord.

8. The device of claim 4, wherein each chalk dust retaining unit further comprises:

a tapered cowl spanning between the circumference of each rigid washer to the cord.

9. The device of claim 5, wherein each chalk dust retaining unit further comprises:

a tapered cowl spanning between the circumference of each rigid washer to the cord.

10. The device of claim 4, wherein the canister includes:

flexible cord and chalk dust retaining unit wiping means to divest said cord and unit of excess chalk when drawn from the canister.

11. The device of claim 5, wherein the canister includes:

flexible cord and chalk dust retaining unit wiping means to divest said cord and unit of excess chalk when drawn from the canister.

12. The device of claim 7, wherein the canister includes:

flexible cord and chalk dust retaining unit wiping means to divest said cord and unit of excess chalk when drawn from the canister.

13. A chalk dust retaining unit for a chalk line marking device, said unit comprising:

a pair of rigid, chalk resistant washers radially outstanding from the flexible cord; and a washer of chalk retaining material sandwiched between the rigid washers and extending at least to all points of the peripheries thereof, so as to contact the working surface when the cord is stretched thereon for use, and to hold the cord away from said working surface.

14. A chalk dust retaining unit for a chalk line marking device, said unit comprising:

a pair of rigid, chalk resistant washers radially outstanding from the flexible cord;

a washer of chalk retaining material sandwiched between the rigid washers and extending at least to all points of the peripheries thereof, so as to contact the working surface when the cord is stretched thereon for use, and to hold the cord away from said working surface; and a tapered cowl spanning between the circumference of each rigid washer to the cord.

15. The device of claim 1, wherein each chalk dust retaining unit comprises:

an elongate axisymmetrical body secured to the cord coaxially therewith, said body having a longitudinally central groove therearound and a pair of conically tapering end portions; wherein the groove contains chalk dust retaining material.

16. The device of claim 15, further comprising:

a chalk dust carrying canister including provisions for the storage of the cord therein, its extension therefrom for use, the impregnation of the chalk retaining washer with chalk dust, and the retraction thereinto for storage subsequent to use.

17. A chalk dust retaining unit for chalk line marking device, said unit comprising:

an elongate axisymmetrical body secured to the cord coaxially therewith, said body having a longitudinally central groove therearound and a pair of conically tapering end portions; wherein the groove contains chalk dust retaining material.

18. The device of claim 1, further comprising an anchoring hook affixed to an end of the cord, said hook comprising:

a thin strip of rigid material having a straight central portion, a pair of oppositely directed end portions perpendicular thereto;

a pivot attaching the hook to the end of the cord at one end of the straight central portion; and a central slot in at least one of the end portions to provide clearance permitting the hook to be rotated about the pivot into a position with the straight central portion in line with and in contact with an end portion of the cord.

19. For a flexible elongate measuring element, the improvement of an anchoring hook to be fixed to an end thereof, said hook comprising:

a thin strip of rigid material having a straight central portion, a pair of oppositely directed end portions perpendicular thereto;

a pivot attaching the hook to the end of the element at one end of the straight central portion; and a central slot in at least one of the end portions to provide clearance permitting the hook to be rotated about the pivot into a position with the straight central portion in line with and in contact with an end portion of the element.

* * * * *